United States Patent [19]

Mueller et al.

[11] Patent Number: 5,075,520

[45] Date of Patent: Dec. 24, 1991

[54] CONTACT MEMBER FOR ELECTRICAL SWITCHING DEVICES

[75] Inventors: Manfred Mueller, Amberg; Franz Graf, Poesing, both of Fed. Rep. of Germany

[73] Assignee: Siemens Aktiengesellschaft, Berlin & Munich, Fed. Rep. of Germany

[21] Appl. No.: 531,131

[22] Filed: May 31, 1990

[30] Foreign Application Priority Data

Jun. 2, 1989 [DE] Fed. Rep. of Germany ..... 8906799

[51] Int. Cl.[5] ..... H01H 33/18; H01H 33/20

[52] U.S. Cl. ..... 200/147 R; 200/144 R

[58] Field of Search ..... 200/147 R, 144 R

[56] References Cited

U.S. PATENT DOCUMENTS

| | | | |
|---|---|---|---|
| 3,211,867 | 10/1965 | Heft | 200/144 |
| 4,237,355 | 12/1980 | Fechant et al. | 200/147 |
| 4,618,748 | 10/1986 | Mueller | 200/144 |
| 4,642,428 | 2/1987 | Yoshiyasu et al. | 200/144 |
| 4,885,441 | 12/1989 | Hisatune et al. | 200/144 |

FOREIGN PATENT DOCUMENTS

| | | |
|---|---|---|
| 2803249 | 8/1978 | Fed. Rep. of Germany . |
| 3337515 | 5/1985 | Fed. Rep. of Germany . |
| 3528196 | 2/1986 | Fed. Rep. of Germany . |
| 3729504 | 3/1988 | Fed. Rep. of Germany . |

*Primary Examiner*—Robert S. Macon

*Attorney, Agent, or Firm*—Kenyon & Kenyon

[57] ABSTRACT

A contact member for electrical switching devices, in particular contactors, having a linear power supply conductor and an arc runner disposed at a distance from the contact face of the linear power supply conductor. The arc runner has a U-shaped design having an unattached end which receives the electric arc. The unattached end is in the same plane as the contact face of the power supply conductor. The U-shaped portions of the arc runner are displaced in parallel and laterally away from the contact face of the linear power supply conductor. The attached end of the U-shaped arc runner is sued to secure the arc runner. For this purpose, a groove is introduced into a block-shaped power supply conductor. A segment, joined to the attached end of the arc runner, is inserted into this groove for securing purposes.

12 Claims, 1 Drawing Sheet

CONTACT MEMBER FOR ELECTRICAL SWITCHING DEVICES

BACKGROUND OF THE INVENTION

This invention relates to contact members for electrical switching devices, in particular contactors, having a linear power supply conductor and an arc runner disposed at a distance from the contact face of the linear power supply conductor and partially guided around this contact face.

In known contact members, the arc runner of the contact member has a U-shaped design. The unattached end of the arc runner receives the electric arc which runs in the plane of the contact face. The U-shaped part of the arc runner is displaced away from the point of contact parallel and lateral to the contact face. The other end of the U-shaped arc runner is used to secure the arc runner.

Such a contact member is disclosed in DE-OS 33 37 515. In practice, this type of contact member has operated satisfactorily. However, the step-shaped power supply conductor may become mechanically deformed in large contactors having considerable amperages, thus possibly affecting the contact closure.

Block-shaped contact members are disclosed in U.S. Pat. No. 3,211,867. However, the arc runner is screwed onto the front side of the power supply conductor. An insulting layer is arranged between the arc runner and the power supply conductor so that the power supply conductor and the arc runner have a peaking-effect on the actuation of the electric arc. The distance between the two branches of the U-shaped arc runner is relatively small in this case and thus the driving effect on the electric arc is not particularly great. In addition, the contact face lies practically in the same plane as the entire arc runner, so that the movable contact member requires precise guidance to prevent the contact face of the movable contact member from coming to rest on the arc runner.

A similar contact member is described in DE-OS 28 03 249. Here, the conductor also has a U-shaped design. This contact member is limited to applications requiring devices having minimal current carrying capacity. When there are high currents, the U-shaped conductor causes the connecting bridge to become disengaged. There is a need for an improved contact member that withstands large mechanical stresses.

SUMMARY OF THE INVENTION

This and other needs are satisfied by the present invention for a contact member for electrical switching devices. The power supply conductor has a block-shaped design and is provided with a groove on the side opposite the contact face. A segment is provided on one end of the arc runner that can be inserted into the groove of the power supply conductor for fastening purposes.

The block-shaped power supply conductor is interchangeable and is screwed onto an additional power supply conductor, for example a busbar. The segment at one end of the arc runner and the block-shaped power supply conductor are screwed together in the groove of the block-shaped power supply conductor. Alternatively, the depth of the groove is designed to be less than the thickness of the segment, so that the arc runner is clamped on to the busbar by securing the block-shaped power supply conductor. The segment is staggered opposite one end of the U-shaped arc runner. This keeps the U-shaped section of the arc runner as wide as possible and increases the electric arc actuation.

DETAILED DESCRIPTION

Figure 1:
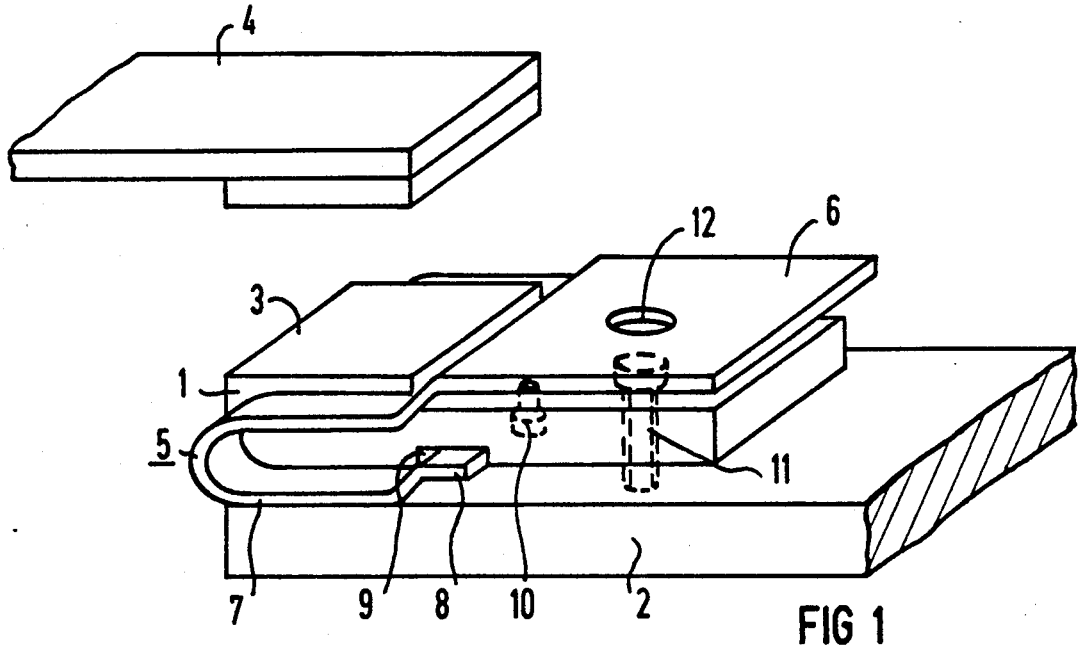
FIG. 1 is the contact member constructed according to the present invention.

Referring to FIG. 1, the contact member of the present invention is shown. The contact member comprises a block-shaped portion 1 of the power supply conductor and a busbar-shaped, additional power supply conductor 2. The power supply conductor has a contact face 3 which works together with a connecting bridge 4. The contact face 3 is soldered onto the block-shaped portion 1 of the power supply conductor. In addition, a U-shaped arc runner 5 is provided. A first unattached end 6 of the arc runner 5 lies more or less in the plane of the contact face 3 of the power supply conductor. A segment 8 is attached to the other end 7 of the arc runner 5 and is inserted into a groove 9 of the block-shaped portion 1. In this embodiment of the invention, the segment 8 is secured by a screw 10.

Figure 4:
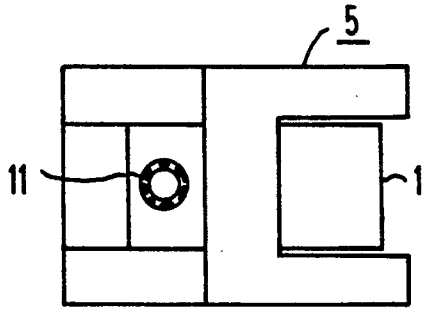
FIG. 4 is a top view of the contact member of FIG. 1.
Figure 2:
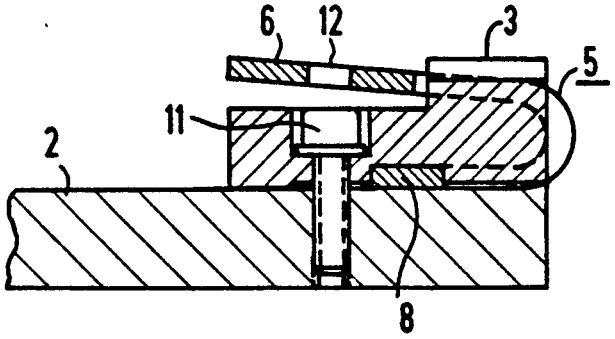
FIG. 2 is a side view of the contact member of FIG. 1.
Figure 3:
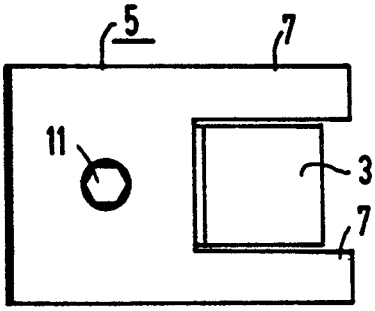
FIG. 3 is a bottom view of the contact member of FIG. 1.

Referring to FIGS. 2 to 4, an alternative contact member of the present invention is shown. The segment 8 is clamped between the block-shaped portion 1 and the busbar 2. The arc runner is designed to be somewhat thicker than in FIG. 1. The segment 8 of the arc runner 5 is clamped to the busbar 2 by screwing the block-shaped portion 1 on tightly. After inserting the segment 8 into the groove 9, the block-shaped portion 1 is screwed onto the additional power supply conductor 2 by a screw 11. The unattached end 6 of the arc runner 5 has an opening 12 for inserting a tool, for example a screwdriver. The segment 8 is set back opposite the end 7 of the arc runner, so that the U-shaped portions of the arc runner 5, situated on opposite sides of the block-shaped portion 1 of the power supply conductor, can be disposed within the widest possible clearance between the ends. As a result, bending of the step-shaped conductor is prevented, even in the case of high amperages, without having to forgo a good arcing run.

We claim:

1. A contact member for an electrical switching device, comprising:

an approximately linear block-shaped power supply conductor, having a contact face on one side and a groove on the opposite side, an arc runner having a U-shaped design comprising a U-shaped end, an unattached end, and an attached end, said arc runner disposed at a distance from the contact face of said linear power supply conductor, said arc runner guided partially around said contact face, said unattached end receiving an electric arc generated at said contact member and being approximately in the plane of said contact face, said U-shaped end displaced parallel and laterally from said contact face, a segment coupled to said attached end and inserted into said groove, and means for holding said segment and block-shaped power supply conductor together.

2. The contact member of claim 1 wherein said electrical switching device is a conductor.

3. The contact member of claim 1, and wherein said means for holding comprise:

a first screw element coupling said segment and said block-shaped power supply conductor together.

4. The contact member of claim 3, and further including:

an additional power supply conductor and a second screw element coupling the block-shaped portion of said power supply conductor to said additional power supply conductor.

5. The contact member of claim 1, wherein the depth of said groove is less than the thickness of said segment.

6. The contact member of claim 5, and further including an additional power supply conductor and wherein said means for holding comprise a screw element coupling the block-shaped portion of said power supply conductor to said additional power supply conductor which said segment pressed between said block-shaped power supply conductor and said additional power supply conductor.

7. The contact member of claim 1, wherein said segment is staggered opposite said attached end of the arc runner.

8. The contact member of claim 2, wherein said segment is staggered opposite said attached end of the arc runner.

9. The contact member of claim 3, wherein said segment is staggered opposite said attached end of the arc runner.

10. The contact member of claim 4, wherein said segment is staggered opposite said attached end of the arc runner.

11. The contact member of claim 5, wherein said segment is staggered opposite said attached end of the arc runner.

12. The contact member of claim 6, wherein said segment is staggered opposite said attached end of the arc runner.

* * * * *